US007874084B2

(12) United States Patent
Earle et al.

(10) Patent No.: US 7,874,084 B2
(45) Date of Patent: Jan. 25, 2011

(54) RECYCLED BICYCLE TIRE FOXING TAPE FOR FOOTWEAR AND METHOD OF MAKING FOOTWEAR

(75) Inventors: John Earle, Portland, OR (US); Leigh Meyer, Ventura, CA (US)

(73) Assignee: Deckers Outdoor Corporation, Goleta, CA (US)

( * ) Notice: Subject to any disclaimer, the term of this patent is extended or adjusted under 35 U.S.C. 154(b) by 775 days.

(21) Appl. No.: 11/811,028

(22) Filed: Jun. 8, 2007

(65) Prior Publication Data

US 2008/0301886 A1 Dec. 11, 2008

(51) Int. Cl.
*A43B 15/00* (2006.01)
*A43B 13/04* (2006.01)

(52) U.S. Cl. ..... 36/32 A; 36/84; 36/17 PW; 36/32 R; 12/142 F; 12/142 D; 12/146 W

(58) Field of Classification Search ..... 36/32 A, 36/9 R, 14, 145, 25 R, 32 R, 84, 17 PW; 12/142 F, 142 R, 146 BR, 142 T, 146 W, 12/142 D See application file for complete search history.

(56) References Cited

U.S. PATENT DOCUMENTS 1,230,510 A * 6/1917 Philp ..... 12/147 R
1,249,292 A * 12/1917 Montgomery ..... 428/181
1,285,992 A * 11/1918 Harley ..... 156/94
1,309,118 A * 7/1919 Dettling et al. ..... 156/94
1,624,913 A * 4/1927 Ames ..... 157/13
2,117,824 A * 5/1938 Rogers ..... 12/146 W
2,361,941 A * 11/1944 Harrison ..... 36/22 R
D155,783 S 11/1949 Crowley
2,757,461 A * 8/1956 Cartmell ..... 36/84
3,145,487 A * 8/1964 Cronin ..... 36/9 R
4,026,044 A 5/1977 Senter
4,068,395 A * 1/1978 Senter ..... 36/83
D319,336 S 8/1991 Mitsui
5,203,793 A 4/1993 Lyden
D337,879 S 8/1993 Byrne et al.
5,369,830 A 12/1994 Chiarabini Bravi
D356,671 S 3/1995 Blanchini
D368,796 S 4/1996 Fabio
D379,861 S 6/1997 Wunsch
D386,893 S 12/1997 Begg et al.
D389,295 S 1/1998 Kelchak
D414,919 S 10/1999 Begg et al.
6,205,604 B1 * 3/2001 Harkins, Sr. ..... 12/146 W
D447,327 S 9/2001 Greenberg
D451,662 S 12/2001 Lucarelli et al.
D475,510 S 6/2003 Reynolds (Continued)

OTHER PUBLICATIONS

Cyndi Rhoades e-mail to Laura Wanek, Re: Worn Again Bicycle Shoe Model; Dec. 28, 2008, p. 1, third paragraph.

(Continued)

*Primary Examiner*—Jila M Mohandesi
(74) *Attorney, Agent, or Firm*—Greer, Burns & Crain, Ltd.

(57) ABSTRACT

A method of manufacturing and article of footwear from a reclaimed bicycle tire includes the steps of providing an article of footwear having an upper attached to a sole, providing a worn bicycle tire, cutting a strip from the tire, and attaching the strip to at least a portion of a peripheral surface of the sole as foxing tape.

7 Claims, 4 Drawing Sheets

U.S. PATENT DOCUMENTS

| | | | |
|---|---|---|---|
| D476,470 | S | 7/2003 | Matis et al. |
| D487,184 | S | 3/2004 | Issler |
| D496,523 | S | 9/2004 | Fuerst |
| D499,863 | S | 12/2004 | Sakai et al. |
| D522,721 | S | 6/2006 | Saunders |

OTHER PUBLICATIONS

Deja Shoe Women's Eco Sneaks, http://www.thegreenloop.com, Jun. 6, 2007.

Vest, H., Recycling of Used Car Tyres, Gate—Technical Information W13e, 2000, p. 4-5.

* cited by examiner

RECYCLED BICYCLE TIRE FOXING TAPE FOR FOOTWEAR AND METHOD OF MAKING FOOTWEAR

FIELD OF THE INVENTION

This invention relates generally to footwear, and particularly to an article of footwear having bicycle tire material used as foxing tape, and a method of making same.

BACKGROUND OF THE INVENTION

The conventional manufacture of footwear results in significant amounts of synthetic waste products. Further, footwear components, such as outsoles and foxing tape, are typically formed of plastic and/or rubber materials. These materials are conventionally made from limited or non-renewable resources, which results in a negative environmental impact.

SUMMARY OF THE INVENTION

A method of manufacturing an article of footwear includes the steps of providing an upper attached to a sole, providing a tire, and cutting a strip from the tire. The method further includes the step of attaching the strip to at least a portion of a peripheral surface of the sole as foxing tape.

An article of footwear includes a sole having a peripheral surface and foxing tape. The foxing tape comprises a portion of a tire that is attached to the peripheral surface of the sole.

DETAILED DESCRIPTION OF PREFERRED EMBODIMENTS

Figure 1:
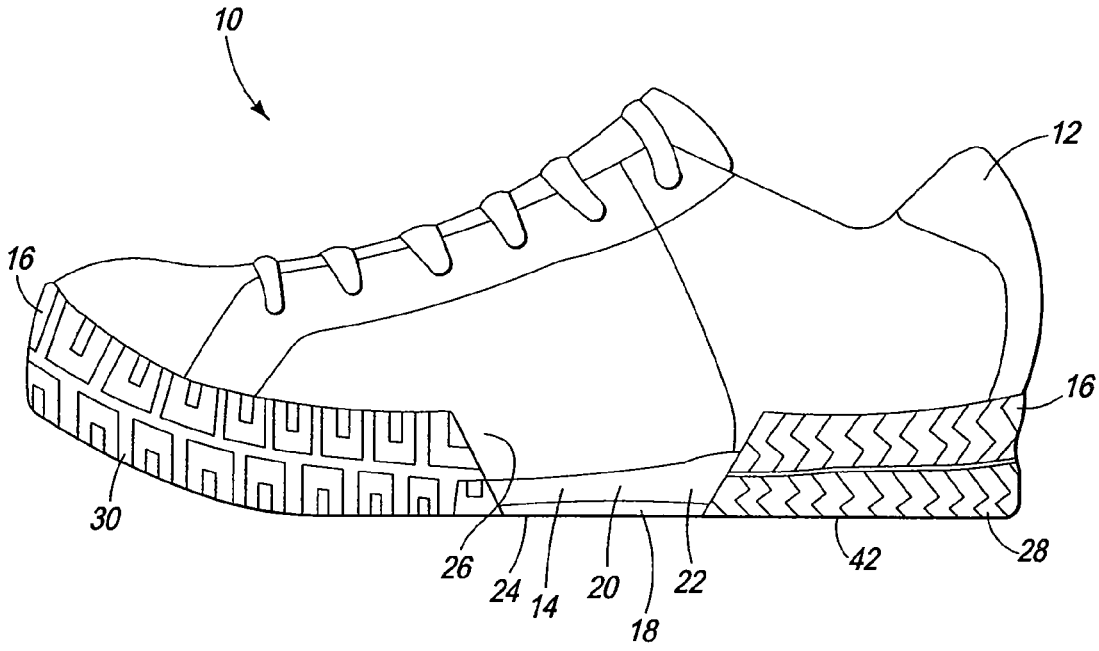
FIG. 1 is an elevational view of a lateral side of an article of footwear of the present invention.

Referring now to FIG. 1 of the drawings, an article of footwear 10 is constructed in accordance with one embodiment of the invention. Specifically, the footwear 10 includes an upper 12, a sole 14 and foxing tape 16 made from recycled bicycle tires. Preferably, the sole 14 includes multiple layers, for example an outsole 18, a midsole 20 and an insole layer (not shown).

The foxing tape 16 is attached to a portion of a peripheral surface 22 of the sole 14 and generally extends from a lower edge 24 of the outsole 18, onto the upper 12, covering the sole and a lower portion 26 of the upper. The foxing tape 16 is disposed on the peripheral surface 22 at a heel region 28 and a forefoot region 30, however it is contemplated that the foxing tape 16 can extend the full periphery of the footwear, or can be disposed at another location on the article of footwear 10 suited for foxing. When assembled, the foxing tape 16 provides a protective cover, wear surface, and/or a decorative feature of the article of footwear 10.

Figure 8:
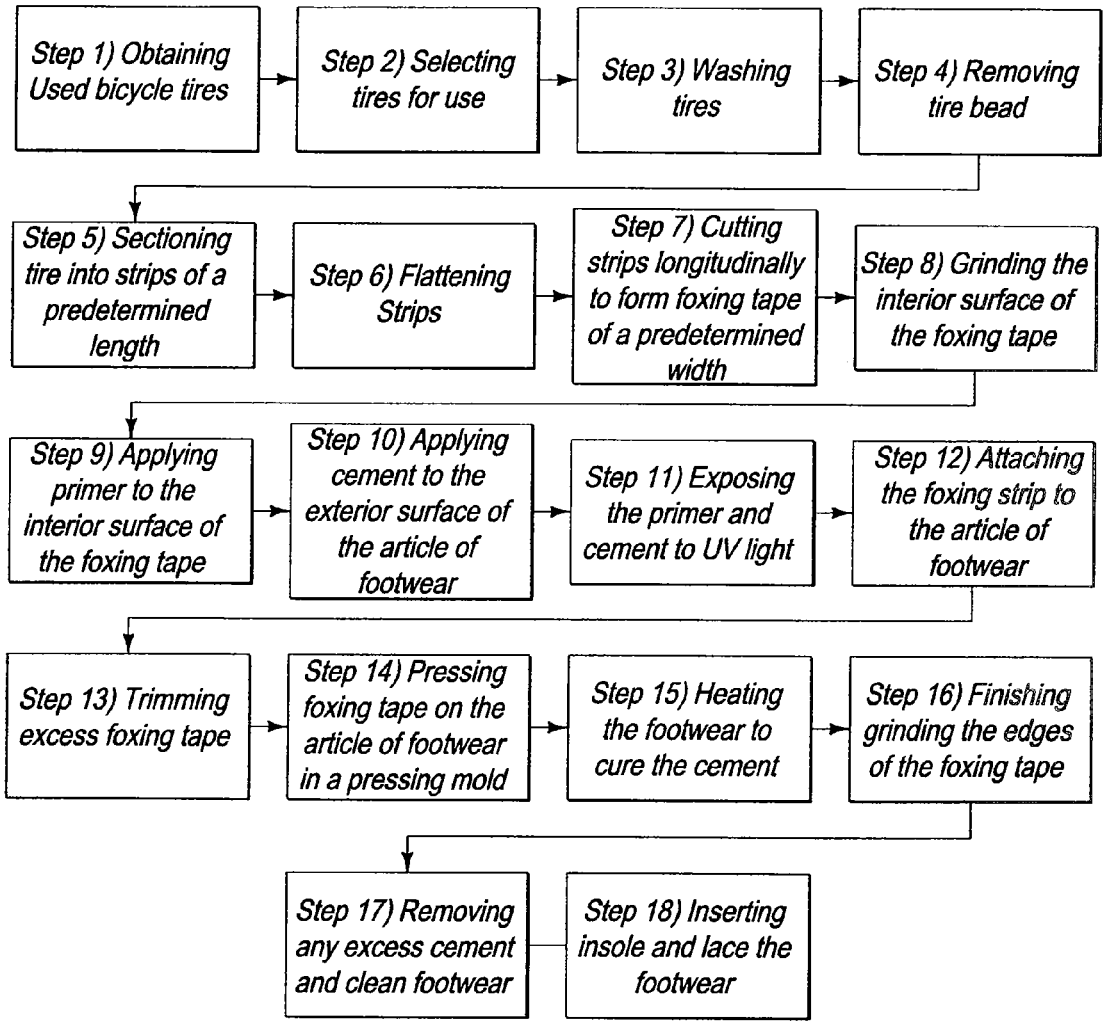
FIG. 8 is a process flowchart of the method of making the present invention.

The method for manufacturing the article of footwear 10 in accordance with the invention includes obtaining a tire 32, preferably a bicycle tire, and more preferably a used bicycle tire (FIG. 8, step 1). Used bicycle tires can be obtained in bulk from bicycle stores. Bicycle tires that have no splits or severe physical damage in the material are selected for use as foxing (FIG. 8, step 2). A tire 32 with a worn, low-relief tread is preferred because it is easier to work with, requires less processing, and is aesthetically desirable. Further, a tire 32 that is pliable and has a smooth inside surface is preferred. The tire 32 is cleaned with water to remove any contaminants from the surface (FIG. 8, step 3).

Figure 2:
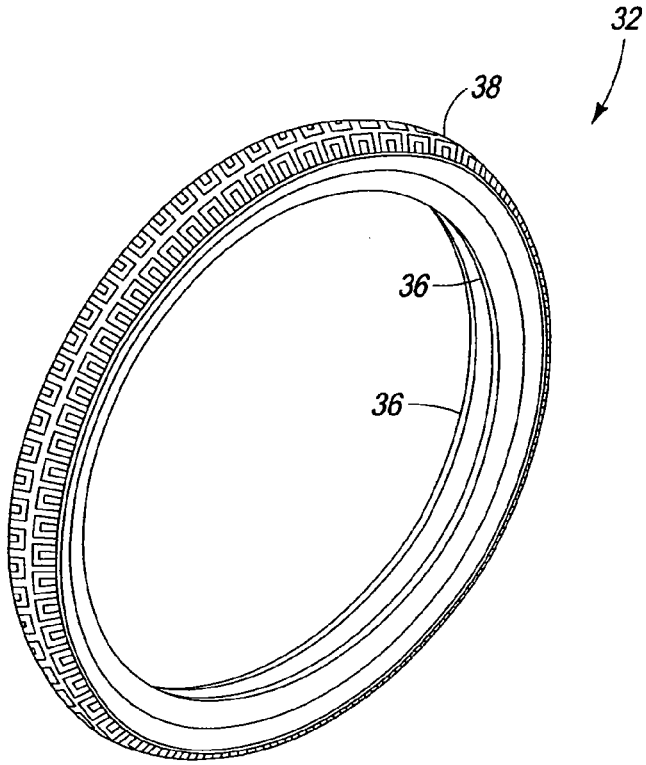
FIG. 2 is a side perspective view of a bicycle tire.
Figure 3:
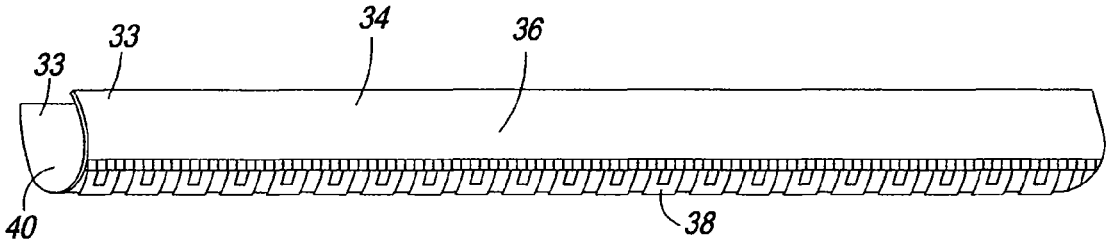
FIG. 3 is a front perspective view of a strip of the tire.

Referring to FIGS. 2-3, the tire 32 is generally circular and has a generally "U"-shaped cross-section. A tire bead portion 33 of each sidewall 36 is cut off of the tire 32 (FIG. 8, step 4). The tire 32 is also cut radially to form a strip 34 of tire 32 of a predetermined length (FIG. 3, FIG. 8, step 5). It is contemplated that the tire bead portion 33 can be cut off the tire 32 either before or after forming the strip 34.

Figure 4:
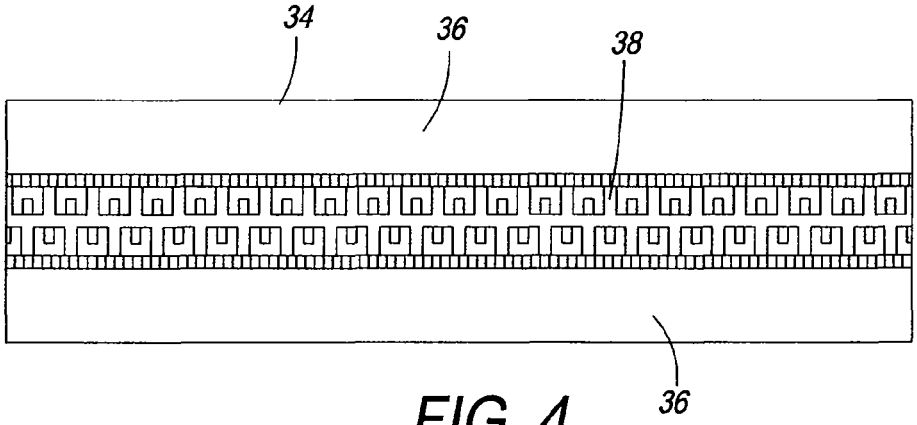
FIG. 4 is a plan view of the strip of tire flattened.
Figure 5:
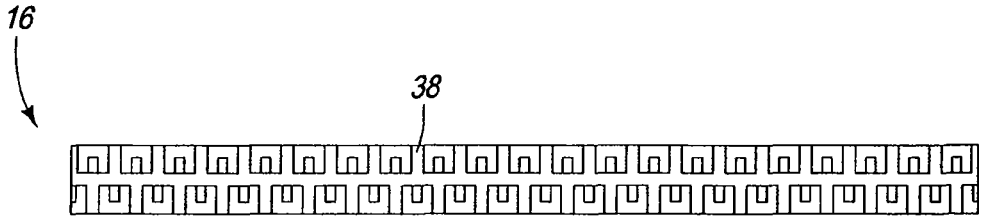
FIG. 5 is a plan view of a strip of foxing tape.

Referring now to FIGS. 4 and 5, the strip 34 is flattened (FIG. 8, step 6) and is cut longitudinally, either manually or with automated machinery, to separate the sidewalls 36 from the tread portion 38 (FIG. 8, step 9). The tread portion 38 is generally straight and flat compared to the relatively rounded sidewalls 36, which makes the tread portion easier to cut or otherwise manipulate. In the preferred embodiment, the tread portion 38 forms the foxing tape 16. Individual pieces of foxing tape 16 can be cut to have desired length and width dimensions for application to the article of footwear 10, for example by using a template or reference lines (FIG. 5). In the preferred embodiment, the foxing tape 16 is cut to have about a 3-cm width.

In assembling the foxing tape 16 to the article of footwear 10, the sole 14 is attached to the upper 12, by any conventional means, such as by stitching or gluing them together. Subsequently, the foxing tape 16 is attached to the sole 14 and the upper 12 as described below.

The inner surface 40 of the foxing tape is ground to remove any inner textile casing or other unwanted debris, and to roughen the inner surface of the tire to improve bonding to the sole 14 and the upper 12 (FIG. 8, step 8). Preferably, a conventional high speed wheel grinder is used to grind the inner surface 40. Preferably, the cleaning and roughening processes occur after cutting the foxing tape 16 to the desired length and width dimensions, however, the cleaning and roughening steps can also occur before cutting the foxing tape. Alternately, the surface of the upper 12 and/or the inner surface 40 of the foxing tape 16 can be chemically treated, heat treated or otherwise modified so that the surface characteristics of the upper and/or the foxing tape can provide the desired bonding between the materials.

A primer, such as a conventional solvent based primer, is applied to the inner surface 40 of the foxing tape 16 (FIG. 8, step 9). Cement is applied to the lower portion 26 of the upper 12 and the peripheral surface 22 of the sole 14 (FIG. 8, step 10). The primer and the solvent can be applied by an automated device or manually, such as with a sponge or a brush. Then, ultra-violet light or heat is applied to the inner surface 40 of the foxing tape 16 and the upper 12 and the sole 14 to activate the primer and cement (FIG. 8, step 11). Alternatively, and more preferably, non-toxic water based adhesive systems can be used.

After the ultra-violet light treatment, the pre-cut piece or strip 34 of foxing tape 16 is positioned around the peripheral surface 22 of the sole 14 so that an inner surface 40 (see FIG. 3) of the foxing tape 16 contacts the sole. The foxing tape 16 is pressed against the upper 12 and the sole 14 to adhere it to the article of footwear 10 (FIG. 8, step 12). It is contemplated that the application of the foxing tape 16 can be done mechanically or manually. Preferably, a roller is used to press the foxing tape 16 against the article of footwear 10.

After the foxing tape 16 is attached to the article of footwear 10, any portions protruding from the sole 14 can be trimmed so that a bottom edge 42 of the foxing tape is flush with the lower surface 24 of the outsole 18 (FIG. 8, step 13).

The article of footwear 10 with applied foxing tape 16 is then preferably placed into a pressing mold where the foxing tape is uniformly pressed against the upper 12 and the sole 14 (FIG. 8, step 14). Preferably after pressing it in the pressing mold, heat is applied to the article of footwear 10 in a heat tunnel to cure the cement (FIG. 8, step 15).

Surface blemishes or burrs on the foxing tape 16 are buffed smooth (FIG. 8, step 16), and any excess cement and/or primer are cleaned off of the article of footwear 10 (FIG. 8, step 17). Water is used to wash the sole 14 and the foxing tape 16.

Other components can be added to the article of footwear 10 before, during or more preferably after the foxing tape 16 is attached to the article of footwear. For example, a sockliner and laces can be inserted into the article of footwear after the foxing tape 16 is attached (FIG. 8, step 18).

Figure 6:
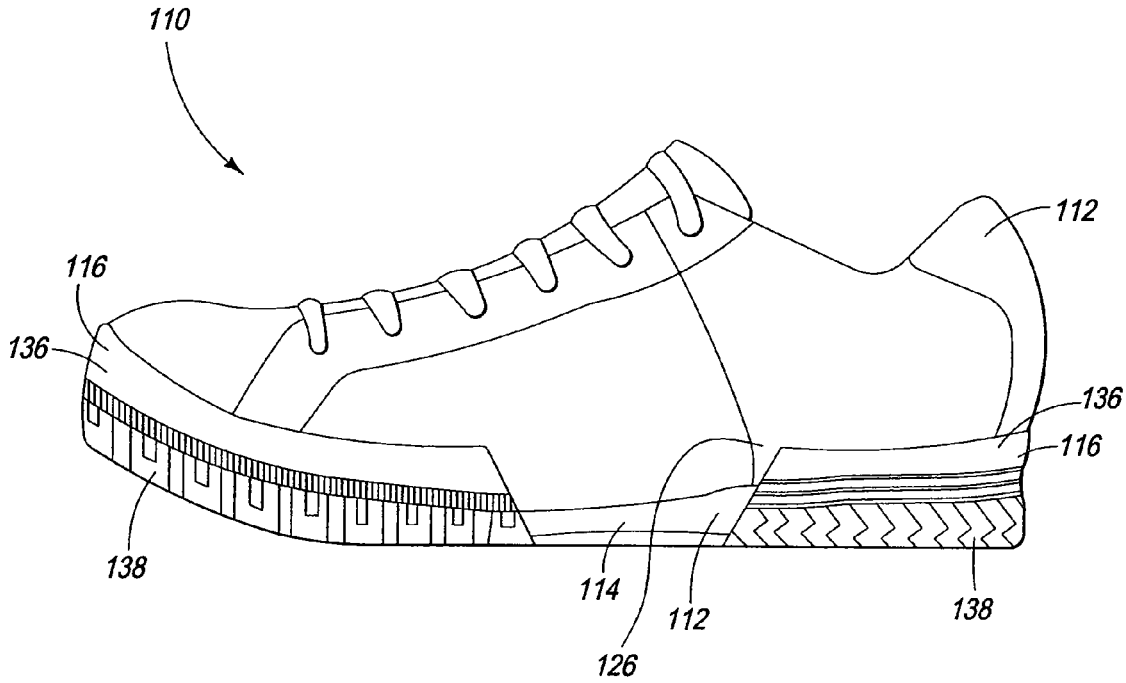
FIG. 6 is an elevational view of a lateral side of an alternate embodiment of footwear of the present invention.
Figure 7:
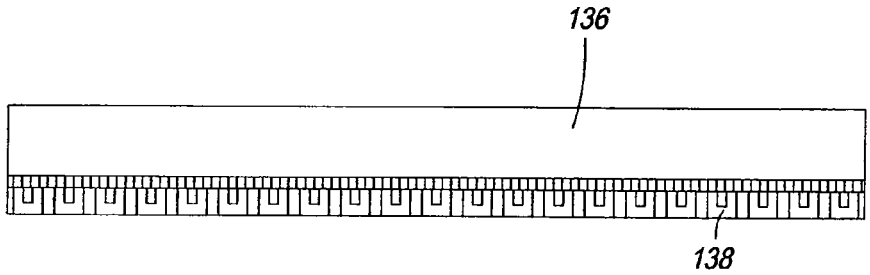
FIG. 7 is a plan view of an alternate strip of foxing tape.

In an alternate embodiment of an article of footwear 110 shown in FIG. 6, the foxing tape 116 includes a tread portion 138 and a portion of the bicycle tire sidewall 136. Referring to FIGS. 6 and 7, the tire is cut to separate an upper portion of the sidewalls from a lower portion of the sidewalls 136 and the tread portion 138. The remaining lower portion of the sidewalls 136 and the tread portion 138 together form the foxing tape 116. In the preferred embodiment, the foxing tape 116 is cut to have a 3-cm width, with the tread portion 138 being about 2-cm in width and the lower portion of the sidewall 136 being about 1-cm in width. The foxing tape 116 is attached to the article of footwear 110 in generally the same way as the first embodiment, but with the tread portion 138 generally coextending with the peripheral surface 122 of the sole 114 and the sidewall 136 generally coextending with a lower portion 126 of the upper 112.

While the preferred embodiments of the present invention have been shown and described, it is to be understood that these are merely examples for practicing the invention that the inventor foresees at the present time, and that various modifications and changes could be made thereto.

What is claimed is:

1. A method of manufacturing an article of footwear comprising:

providing an upper attached to a sole;

providing a worn bicycle tire having an inner surface and an outer surface opposite of said inner surface;

cutting a strip from said bicycle tire; and attaching said strip to at least a portion of a peripheral surface of said sole as foxing tape, wherein said outer surface of said strip is an exposed surface of said foxing tape;

wherein said tire comprises a tread portion and a sidewall portion, wherein said cutting step comprises cutting said strip from said tire to include at least a portion of said tread portion.

2. The method of claim 1 wherein said cutting step comprises cutting said strip from said tire to include at least a portion of said tread portion and said sidewall.

3. The method of claim 1 further comprising the step of grinding an inner surface of said strip prior to attaching said strip to said sole.

4. The method of claim 1 wherein said attaching step comprises:

applying a primer to an inner surface of said strip;

applying cement to said upper and said sole;

activating the primer and cement with ultra-violet light; and applying said strip to said upper and said sole to adhere it to the article of footwear.

5. The method of claim 1 wherein said tire is a reclaimed bicycle tire.

6. The method of claim 1 further comprising the step of pressing said strip against said sole and said upper.

7. A method of manufacturing an article of footwear comprising:

providing an upper attached to a sole;

selecting a bicycle tire having a worn outer surface including a tread portion and a sidewall portion;

cleaning the bicycle tire;

radially cutting a strip from the bicycle tire;

trimming the strip longitudinally to include at least a portion of the tread portion of the tire on the outer surface;

grinding an inner surface of the strip to remove unwanted material and to roughen the inner surface; and cementing the inner surface of the strip to at least a portion of a peripheral surface of the footwear to cover said sole and a portion of said upper to form foxing tape.

* * * * *